US009399916B2

(12) United States Patent
Thorwart et al.

(10) Patent No.: US 9,399,916 B2
(45) Date of Patent: Jul. 26, 2016

(54) FLUID-ACTUATED ROTARY DRIVE DEVICE

(75) Inventors: Gerhard Thorwart, Filderstadt (DE); Ulrich Hohl, Plochingen (DE); Frank Menikheim, Esslingen (DE)

(73) Assignee: FESTO AG & CO. KG, Esslingen (DE)

( * ) Notice: Subject to any disclaimer, the term of this patent is extended or adjusted under 35 U.S.C. 154(b) by 377 days.

(21) Appl. No.: 13/983,368

(22) PCT Filed: Sep. 28, 2011

(86) PCT No.: PCT/EP2011/004839
§ 371 (c)(1),
(2), (4) Date: Aug. 2, 2013

(87) PCT Pub. No.: WO2013/044934
PCT Pub. Date: Apr. 4, 2013

(65) Prior Publication Data
US 2013/0309115 A1 Nov. 21, 2013

(51) Int. Cl.
*F01C 1/324* (2006.01)
*F15B 15/12* (2006.01)

(52) U.S. Cl.
CPC ..... *F01C 1/324* (2013.01); *F15B 15/12* (2013.01)

(58) Field of Classification Search
CPC ..... F15B 15/12; F15B 15/125; F01C 1/324; F01C 1/34; F01C 1/14; F01C 1/08
USPC ..... 92/120, 121, 122, 125
See application file for complete search history.

(56) References Cited

U.S. PATENT DOCUMENTS

| | | | | |
|---|---|---|---|---|
| 3,237,528 | A * | 3/1966 | Rose | F16K 31/12 91/409 |
| 4,492,150 | A * | 1/1985 | Yates | F15B 15/12 417/481 |
| 5,017,106 | A * | 5/1991 | Holss | F04C 27/008 417/481 |
| 5,732,613 | A * | 3/1998 | Stoll | F15B 15/2892 92/121 |
| 2003/0126985 | A1 * | 7/2003 | Collier | B25J 9/148 92/120 |
| 2006/0039776 | A1 * | 2/2006 | Schutz | F16B 37/0885 411/432 |
| 2006/0137150 | A1 * | 6/2006 | Ishizaki | A44B 18/0053 24/585.1 |

FOREIGN PATENT DOCUMENTS

| | | |
|---|---|---|
| DE | 2905193 | 8/1980 |
| DE | 19511488 A1 | 10/1996 |
| DE | 19511488 C2 | 9/1998 |

(Continued)

OTHER PUBLICATIONS

JP 60192287—Machine Translation from USPTO, Detachable stopper of vane-type swing motor, Pub date—Dec. 1985.*

(Continued)

*Primary Examiner* — Nathaniel Wiehe
*Assistant Examiner* — Richard Drake
(74) *Attorney, Agent, or Firm* — Hoffmann & Baron, LLP

(57) ABSTRACT

A fluid-actuated rotary drive device is provided, with a housing (2) in which is formed a working chamber (3), in which is a swivel piston (18) able to swivel around a central axis (5). Also fitted or able to be fitted in the working chamber (3) is a space divider and stop unit (38), comprised of a space divider element (24) and at least one stop element (42) fixed to the former. The components of the space divider and stop unit (38) are fitted to one another by snap-in connection, so that the space divider and stop unit (38) is easy to handle during its installation in the working chamber (3).

18 Claims, 9 Drawing Sheets

(56) References Cited

FOREIGN PATENT DOCUMENTS

| | | | |
|---|---|---|---|
| DE | 102007012398 | A | 9/2008 |
| FR | 1566834 | | 5/1969 |
| JP | 60192287 | | 12/1985 |

OTHER PUBLICATIONS

DE 19511488—Machine Translation from ESPACENET, Oscillating piston fluid-driven motor, Pub date—Oct. 1996.*

* cited by examiner

FLUID-ACTUATED ROTARY DRIVE DEVICE

This application claims priority based on an International Application filed under the Patent Cooperation Treaty, PCT/EP2011/004839, filed Sep. 28, 2011.

BACKGROUND OF THE INVENTION

The invention relates to a fluid-actuated rotary drive device, with a housing in which is formed a working chamber, which has at least partially a circular external contour extending concentrically in a main circumferential direction around a central axis, wherein there is mounted in the working chamber a swivel piston connected torque-proof to an output member accessible from outside the housing and able to execute a swivelling movement around the central axis, and with a space divider and stop unit which, in adopting an operating position, is or may be inserted in the working chamber so as to be immovable in such a way that it divides the working chamber, together with the swivel piston, into two drive chambers which may be pressurised in a controlled manner by a driving fluid to generate the swivelling movement of the swivel piston, and at the same time presets the maximum possible swivel angle of the swivel piston, wherein the space divider and stop unit has a space divider element fixed immovably to the housing with sealing in the operating position and at least one stop element separate from the space divider element and fitted or able to be fitted to the space divider element at an assembly interface while adopting a stop position on at least one of the two sides oriented in the main circumferential direction.

A rotary drive device of this kind known from JP 60-192287 U has a swivel piston fitted with the ability to swivel in a working chamber and which, together with a space divider and stop unit similarly inserted in the working chamber, makes a fluid-tight separation from one another of two drive chambers, each of which may be pressurised in a controlled manner by a driving fluid in order to generate the swivelling movement of the swivel piston. The space divider element consists of several elements releasably connected, in particular a space divider element, and a stop element separate from the former. The space divider element carries a seal with which it cooperates in sealing not only with the housing of the rotary drive device but also with the swivel piston. If it is used without an additional drive element, it simultaneously forms a stop for the swivel piston. A different maximum possible swivel angle of the swivel piston may be preset by the stop element which may be attached additionally. Before installation in the working chamber, the space divider and stop unit may be pre-assembled into an assembly module. In particular with a larger number of elements, handling is relatively laborious, since care must be taken to ensure that the space divider and stop unit does not fall apart. This is especially problematic in series production, in which short assembly times are important.

Known from DE 19511488 C2 is a rotary drive device described as a swivel piston motor which has a housing defining a working chamber, wherein the working chamber contains a swivel piston and an immovable inserted space divider. For presetting the swivel angle of the swivel piston, a setting device is provided on the outside of the housing and allows variable presetting of the swivel angle.

SUMMARY OF THE INVENTION

The invention is based on the problem of taking measures to promote cost-efficient and quick assembly of a rotary drive device equipped with a swivel piston.

To solve this problem it is provided, in conjunction with the features described above, that each stop element is fixed in its stop position by sole interaction with the space divider element by means of a snap-in connection on the space divider element, with snap-in connection means formed on the stop element making positive snap-in engagement with complementary snap-in connection means formed on the space divider element.

This provides the advantageous possibility, in assembly of the rotary drive device, of providing the space divider and stop unit as a coherent assembly module prior to insertion in the working chamber. The pre-assembled elements—i.e. the space divider element and at least one stop element—are fixed to one another and held captive by the mutually cooperating snap-in connection means, and need no external influence for their cohesion. Installation of the space divider and stop unit in the working chamber may in this way be effected in a time-saving manner and with minimal handling effort, thereby making possible cost-efficient series production of the rotary drive device.

Advantageous embodiments of the invention are disclosed in the dependent claims.

The space divider element has two opposing sides oriented in the main circumferential direction of the working chamber, wherein there is provided on only one of these two sides or on both sides an assembly interface with assigned snap-in connection means which make possible the attachment of a stop element equipped with complementary snap-in connection means. The provision of an assembly interface on both sides makes it possible to equip the space divider element with at least one stop element either just on one side or simultaneously on both sides, depending on the desired swivel angle presetting. If the space divider element has an assembly interface on only one side. It can be equipped with one or more stop elements only on one side.

It is possible to preset different swivel angles for one and the same rotary drive device for example by providing that, in the main circumferential direction, stop elements with different circumferential lengths are or may be fitted alternatively to the space divider element. This assumes, however, the provision of stop elements of differing design.

It is regarded as an advantageous measure for variable presetting of different swivel angles if the rotary drive device is equipped with several stop elements which, forming a stop element chain, are or may be fitted to at least one of the assembly interfaces of the space divider element. The directly consecutive stop elements in the main circumferential direction are here fixed to one another by complementary snap-in connection means, just like the first stop element of the stop element chain and the space divider element. The stop element which terminates the stop element chain on the side opposite the space divider element has a stop face for the swivel piston to preset its maximum swivel angle.

If the space divider element is equipped with two assembly interfaces on opposite sides, then these assembly interfaces may at the same time be equipped with a different number of stop elements. So for example on one assembly interface just a single stop element may be fixed by snap-in engagement, while at the same time a stop element chain comprised of two or even more stop elements may be fixed by snap-in engagement at the other assembly interface.

This provides a highly modular structure for the space divider and stop unit with the option, depending on the number and distribution of stop elements, of presetting different maximum swivel angles for the swivel piston.

Each stop element which is or may be integrated in the space divider and stop unit has two first and second end faces opposite one another and oriented in the main circumferential direction, wherein expediently there is formed in the area of the first end face a first mounting interface with snap-in connection means for snap-in connection with an assembly interface formed on the space divider and having complementary snap-in connection means. In the area of the second end face of the stop element there is expediently provided a second mounting interface complementary to the first mounting interface and with snap-in connection means complementary to the snap-in connection means of the first mounting interface. This creates the simple advantageous possibility of connecting several stop elements through snap-in connection of their complementary first and second mounting interfaces to form a stop element chain.

Expediently formed in the area of the second end face of each stop element is a stop face for the swivel piston. This comes into effect when no further stop element is fitted to this second end face. Expediently therefore each stop element has at the second end face a second mounting interface and a stop face.

An especially cost-effective variant of the rotary drive device provides for all stop elements to be identical in form. The stop elements may then be made using one and the same shaping tool. Maximum swivel angles of the swivel piston of different magnitude may then be preset by the integration of differing numbers of stop elements in the space divider and stop unit.

Especially advantageous is a design of the space divider and stop unit such that the diverse elements connected to one another by snap-in connection may also be released from one another at any time. In other words, expediently, releasable snap-in connections are used.

Each stop element is preferably so designed that, after its fitting, the swivel angle available to the swivel piston is 45° less than with the stop element not fitted. For this purpose each stop element has preferably a dimension in the main circumferential direction conforming to a curve angle of 45°.

The rotary drive device facilitates an especially compact design when the stop elements have a curved circular arc shape in particular such that, in the operating position of the space divider and stop unit, they follow the main circumferential direction. Stop elements thus designed take up only very little space in the radial direction of the central axis, so that the working chamber may if required have a very small diameter.

Each stop element has preferably at least substantially a shape corresponding to a circumferential section of a hollow cylinder.

A design of this kind applies expediently to the whole space divider and stop unit. The latter has preferably a curved circular arc shape in which the centre of curvature, viewed in the operating position, lies on the central axis.

Preferably each stop element has an inner surface which, in the operating position, faces the swivel piston and the central axis respectively and has a circular arc shape, wherein the curve centre lies on the central axis. The inner surface has preferably the shape of a circumferential section of the lateral surface of a circular cylinder.

The complementary snap-in connection means are expediently in each case component parts of a plug connection device formed on the elements to be fixed to one another. Consequently both the space divider element and each stop element which may be engaged with the space divider element together form a plug connection device, the components of which are located partly on the space divider element and partly on the stop element. Similarly, two stop elements connected to one another to form a stop element chain form a plug connection device in the joining area, the components of which are located partly on one and partly on the other stop element.

Each plug connection device is in particular so designed that the direction of plugging-in, in which the elements to be fitted together are moved relative to one another during the assembly process, runs in a radial direction relative to the central axis, when the arrangement is viewed in the operating position of the space divider and stop unit, When the space divider and stop unit has a circular arc shape with a certain centre of curvature, then the plug connection devices are in particular so designed that the direction of plugging-in runs in the radial direction relative to this centre of curvature and/or in a plane at right-angles to the central axis.

The snap-in connection means which are complementary to one another are preferably hook-shaped, but may also take another form.

The space divider element has preferably a multi-component structure, including a base body which lends the space divider element stability, and a seal fixed to the base body by material bonding and, in the operating position, in sealing contact with the housing of the rotary drive device. The seal may be fixed to the base body in particular by injection moulding.

BRIEF DESCRIPTION OF THE DRAWINGS

The invention is described in detail below with the aid of the appended drawing which shows in.

DETAILED DESCRIPTION OF THE PREFERRED EMBODIMENTS

Figure 1:
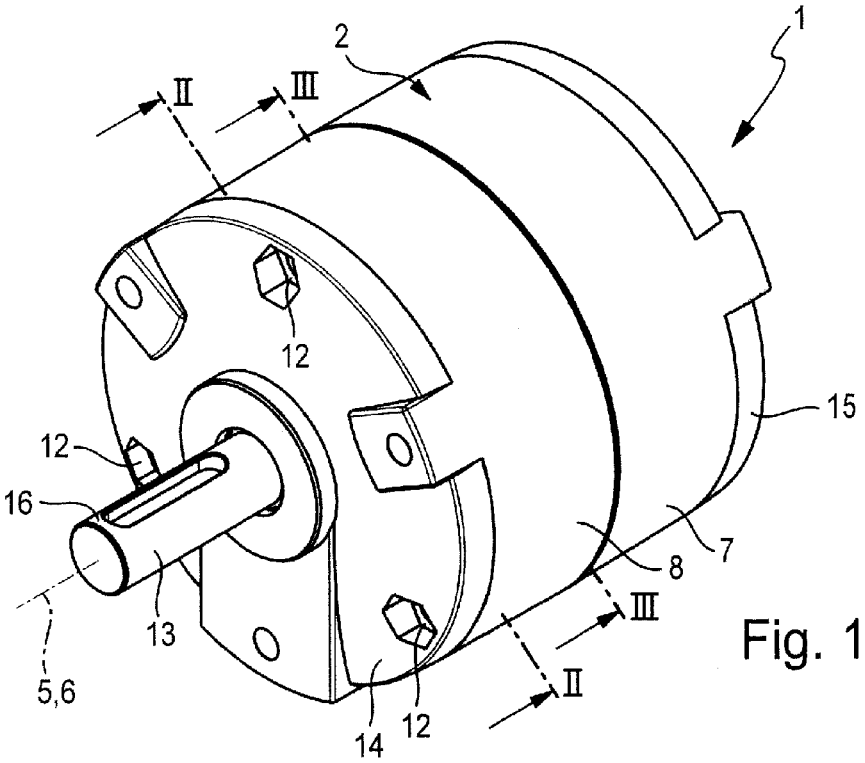
FIG. 1 a preferred embodiment of the rotary drive device according to the invention in a perspective view FIG. 2 a cross-section through the rotary drive device of FIG. 1 along section line II-II FIG. 3 the rotary drive device of FIG. 1 in a perspective view and seen with the housing split along section line III-III FIG. 4 a detail view of the space divider and stop unit fitted to the rotary drive device of FIGS. 1 to 3

The fluid-actuated rotary drive device designated in its totality by reference number 1 has a housing 2, in which is formed at least one substantially cylindrical working chamber 3, which has a preferably circular-cylindrical lateral surface 4 which is responsible for a circular external contour of the working chamber 3. This lateral surface 4 extends coaxially around an imaginary central axis 5 which preferably coincides with the longitudinal axis 6 of the housing 2. The working chamber 3 is also bounded by two axial end faces, spaced apart in the axial direction of the central axis 5.

Preferably the housing 2 has a substantially circular-cylindrical external contour. It is also of advantage if it is comprised of two preferably equal housing parts 7, 8, arranged consecutively along the longitudinal axis 6 and joined together with sealing in a joining plane at right-angles to the central axis 5. Each of these housing parts 7, 8 is cup or pot-shaped and defines with its interior an axial half of the working chamber 3. The two housing parts 7, 8 are put together with their open sides leading to form the working chamber 3 and joined together by means of screws 12 or other means of connection. The screw holes are not shown in the sectional views of the drawing.

An output member 13, by way of example in the form of a shaft, passes coaxially through the working chamber 3. The output member is rotatably mounted in two end walls 14, 15 of the housing 2, spaced apart on the longitudinal axis 6, by means of suitable bearing devices. Each of the two end walls 14, 15 defines one of the two end faces axially bounding the working chamber 3.

The output member 13 passes through at least one and preferably both end walls 14, 15. Here at least one end section of the output member 13 extending out from the housing 2 forms a tapping section 16 at which a rotary movement may be tapped. A machine part, for example, may be actuated by such a rotary movement.

Inside the working chamber 3 is a swivel piston 18 which may be driven by fluidic pressurisation to make a swivelling movement indicated by a double arrow 17.

The swivel axis for the swivelling movement 17 of the swivel piston 18 coincides with the central axis 5. The swivel piston 18 is also connected non-rotatably to the output member 13, which is realised preferably by form-fitting of a bushing section 22 of the swivel piston 18 with internal teeth on to a length section of the output member 13 having external teeth and passing through the working chamber 3.

Other means of non-rotatable connection of the bushing section 22 to the output member 13 are also possible, in particular designing them as a single-piece unit.

The working chamber 3 has a larger diameter than the outside diameter of the bushing section 22. This creates an annular space 21 extending all around the bushing section 22, but which is interrupted at two points. One interruption results from a vane section 23 of the swivel piston 18, and the other interruption from a space divider element 24, to be explained in more detail, inserted immovably in the working chamber 3.

The vane section 23 protrudes radially from the outer periphery of the bushing section 22. It passes through the radial width of the annular space 21, making sliding and sealing contact with the lateral surface 4 of the working chamber 3.

In addition the swivel piston 18, with its two axially opposing end faces, formed in each case partly by the bushing section 22 and partly by the vane section 23, makes sliding and sealing contact with the two end faces axially bounding the working chamber 3. The sealing cooperation results from the fact that the swivel piston 18, at least in the areas in which it is in contact with the housing 2, is provided with a sealing structure 25 made of material with rubber-elastic properties.

The sealing structure 25 extends preferably on all sides around the entire swivel piston 18. The swivel piston 18 has in particular a core body 26 made of a rigid and load-bearing material, and coated with the sealing structure 25 on the outside.

At any rate the radially outwards oriented outer lateral surface 27 of the bushing section 22 is made preferably of a material with rubber-elastic properties and is formed in particular by a hollow cylindrical section of the sealing structure 25, arranged concentrically to the central axis 5.

The space divider element 24 is inserted radially between the bushing section 22 and the lateral surface 4 of the working chamber 3, and extends over the entire axial length of the working chamber 3. It has expediently a base body 28 made of a rigid and in particular plastic material, and a seal 29 at least partly covering the outer surface of this base body 28. Preferably, the seal 29 is fixed to the base body 28 by material bonding, in particular by means of an injection moulding process.

The space divider element 24 has on its inner side facing the central axis 5 a sealing face 32 which fits up against the lateral surface of the bushing section 22. It is preferably strip-shaped and extends parallel to the central axis 5. Preferably it is formed by the outer surface of the base body 28 which is not covered by the seal 29 in this area.

The seal 29 extends with an outer sealing section **29*a* along the outside of the space divider element 24 facing radially away from the central axis 5, and is in contact via this outer sealing section 29*a*, with the space divider element 24 fitted and under static sealing, with the lateral surface 4 of the working chamber 3. In addition, the seal 29 has two end sealing sections 29*b*, each extending to one of the two axially oriented end faces of the space divider element 24 and, with the space divider element 24 fitted, making static sealing contact with one of the two axial end faces of the working chamber 3 formed on the end walls 14, 15**.

Together with the swivel piston 18, the fitted space divider element 24 divides the working chamber 3 with sealing into two drive chambers **33*a*, 33*b*, which are arranged consecutively in a circumferential direction around the central axis 5. For better distinction, this circumferential direction is described below as the main circumferential direction 34 and is in the drawing partly designated by the same double arrow as the swivelling movement 17**.

Opening out into each of the two drive chambers 33*a*, 33*b* is one of two control passages 35*a*, 35*b* passing through the housing 2. Through these control passages 35*a*, 35*b*, the two drive chambers 33*a*, 33*b* may be pressurised by a driving fluid or relieved of pressure in a coordinated manner. The pressure difference between the two drive chambers 33*a*, 33*b* produced by this means generates a torque at the swivel piston 18 and effects its swivelling movement 17. This swivelling movement 17 may be tapped as a rotary movement, outside the housing 2, at the tapping section 16 of the output member 13.

The fixing, immovable relative to the housing 2, of the space divider element 24 mounted in the working chamber 3 is produced by direct fixing or attachment of the space divider element 24 to the housing 2. In particular, form-fitting attachment is provided. In the embodiment, the space divider element 24 has at each of its two end faces oriented in the axial direction of the central axis 5 and opposite one another at least one axially protruding bearing projection 36, each engaging in a complementary bearing recess, not further apparent in the drawing, which is formed in the facing axial end face of the end walls 14, 15 which axially bound the working chamber 3. This arrangement may also be transposed.

The bearing projection 36 and the assigned bearing recess are in particular, when they are not only present singly, expediently non-circular in cross-section, so that the fitted space divider element 24 is fixed with stable orientation and in particular also non-rotatable relative to the housing 2.

The space divider element 24 may be provided as part of a multi-part space divider and stop unit 38. This space divider and stop unit 38 also includes, besides the space divider element 24, at least one and preferably several stop elements 42. Preferably the rotary drive device 1 contains a multiplicity of stop elements 42, which may be combined in variable numbers with the space divider element 24 to from the space divider and stop unit 38. The stop elements 42 not integrated in the space divider and stop unit 38 here may be kept for possible conversion of the rotary drive device 1 or used for another rotary drive device 1.

If the space divider and stop unit 38 is installed in the working chamber 3, it adopts a position designated as "operating position". This operating position is preset irrevocably by the preferably direct mounting of the space divider element 24 on the housing 2. Here the space divider element 24 performs the dividing function referred to above in respect of the two drive chambers 33*a*, 33*b* which may be supplied with fluid pressure, and also functions as support for the stop elements 42 expediently not fastened directly to the housing 2.

The space divider and stop unit 38 also serves to preset for the swivel piston 18 the maximum possible swivel angle in the course of its swivelling movement 17. In this respect the space divider and stop unit 38 performs a stop function. The swivel piston 18 may be swivelled between two swivel end positions in which it makes contact with one of the two vane edges 43*a*, 43*b* of its vane section 23 which lie opposite one another and are oriented in the main circumferential direction 34, on the space divider and stop unit 38 lying in the swivel path.

To carry out the aforementioned stop function the space divider and stop unit 38 has two stop faces 44*a*, 44*b* which are oriented in the main circumferential direction 34 and facing toward the vane section 23. They are oriented opposite one another in the main circumferential direction 34, with the one stop face 44*a* designed to interact with the one vane edge 43*a* and the other stop face 44*b* designed to interact with the other vane edge 43*b*.

The two stop faces 44*a*, 44*b* are located at the two opposite end sections, oriented in the main circumferential direction 34, of the space divider and stop unit 38. In the embodiment, both stop faces 44*a*, 44*b* are formed on a stop element 42 fixed to the space divider element 24, in each case adopting a stop position.

The space divider element 24 has two sides 30, opposite one another and each oriented in the main circumferential direction 34, at which it is equipped with in each case one of two assembly interfaces 45*a*, 45*b*. Each of these assembly interfaces 45*a*, 45*b* is equipped with snap-in connection means 46*a*, 46*b*. Each of the two assembly interfaces 45*a*, 45*b* is suitable for having a stop element 42, adopting a stop position, fastened to it.

Each stop element 42 has, viewed in the operating position, two first and second end faces 47*a*, 47*b*, opposite one another and oriented in the main circumferential direction 34. Formed in the area of the first end face 47*a* is a first mounting interface 48*a* with snap-in connection means 49*a*, while in the area of the second end face 47*b* there is formed a second mounting interface 48*b* with snap-in connection means 49*b*.

The two assembly interfaces 45*a*, 45*b* provided on the opposite sides 30 of the space divider element 24 are identical to one another, but mirror-symmetrical relative to a radial plane 52 running between them and containing the central axis 5.

Each assembly interface 45*a*, 45*b* including the snap-in connection means 46*a*, 46*b* belonging to it has a complementary design to the first mounting interfaces 48*a* and their assigned snap-in connection means 49*a*. In this way it is possible to fix each stop element 42 with its first mounting interface 48*a* to each of the two assembly interfaces 45*a*, 45*b*, to form a snap-in connection.

In addition, each second mounting interface 48*b* including the associated snap-in connection means 49*b* is designed to be complementary to the first mounting interface 48*a* including the snap-in connection means 49*a* belonging to this first mounting interface 48*a*. Preferably each assembly interface 45*a*, 45*b* is identical in form to each second mounting interface 48*b*.

This design makes it possible to fix stop elements 42 to one another by bringing them into engagement with their first and second mounting interfaces 48*a*, 48*b*, to create a snap-in connection.

All embodiments make clear that at each of the two assembly interfaces 45*a*, 45*b* of the space divider element 24 oriented opposite one another, a stop element 42 may be fixed as part of a snap-in connection by means of the first mounting interface 48*a* formed on it. The snap-in connection means 46*a*, 49*a* and 46*b*, 49*a*, which in this connection make form-fitting engagement with and are complementary to one another, ensure captive cohesion of the elements fastened together on account of positive interlocking.

Figure 2:
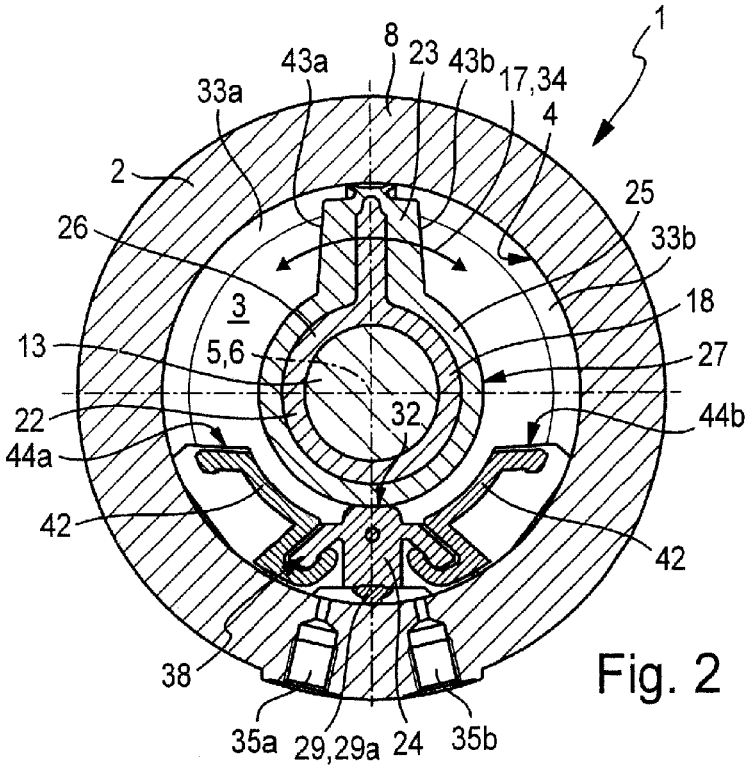
Figure 3:
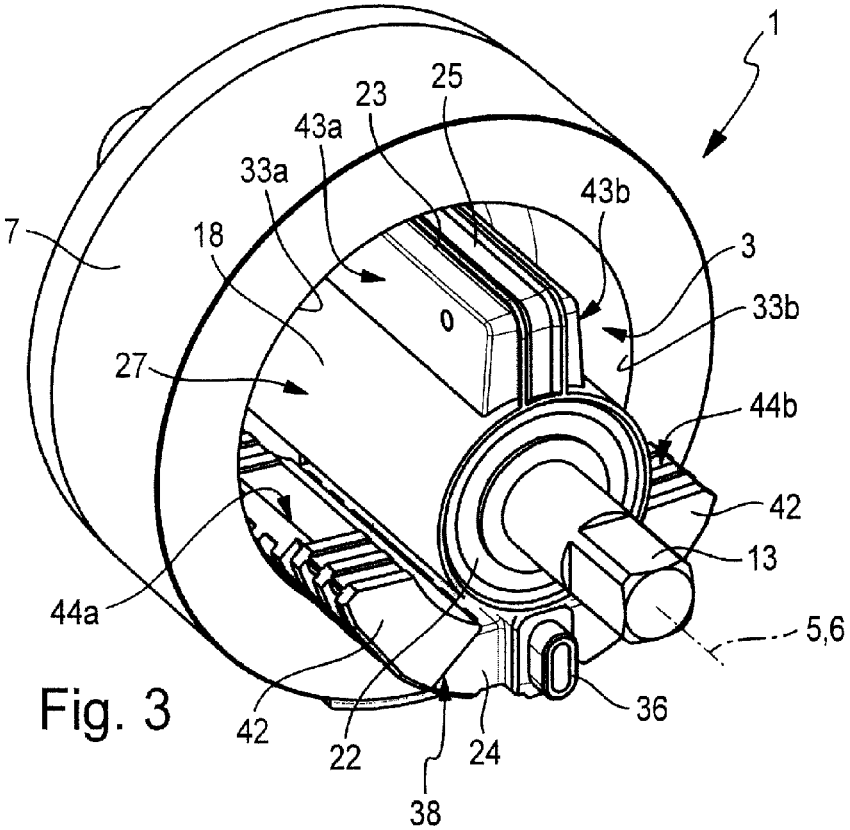
Figure 4:
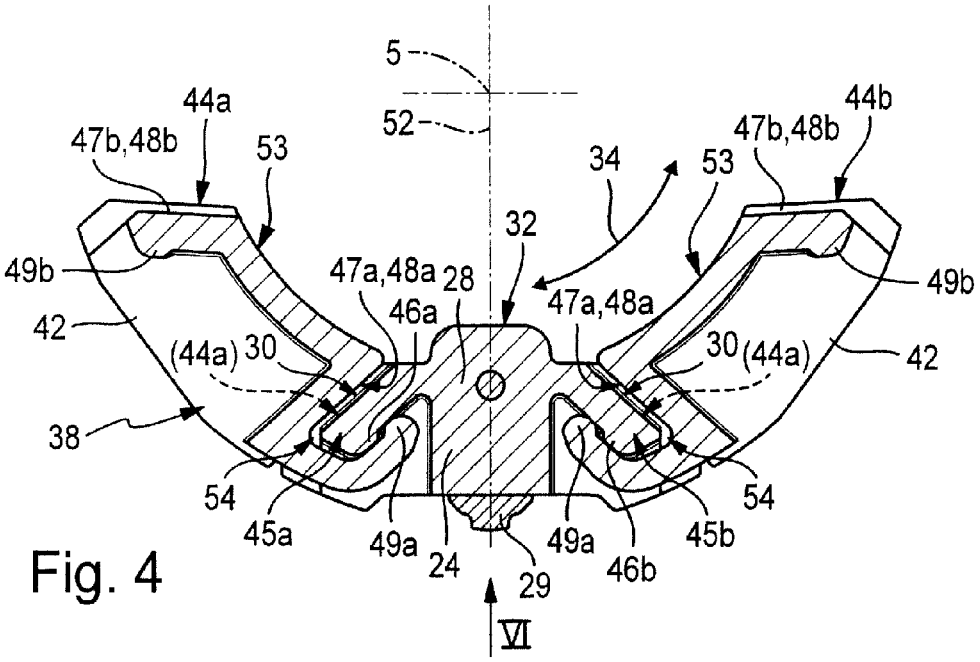
Figure 5:
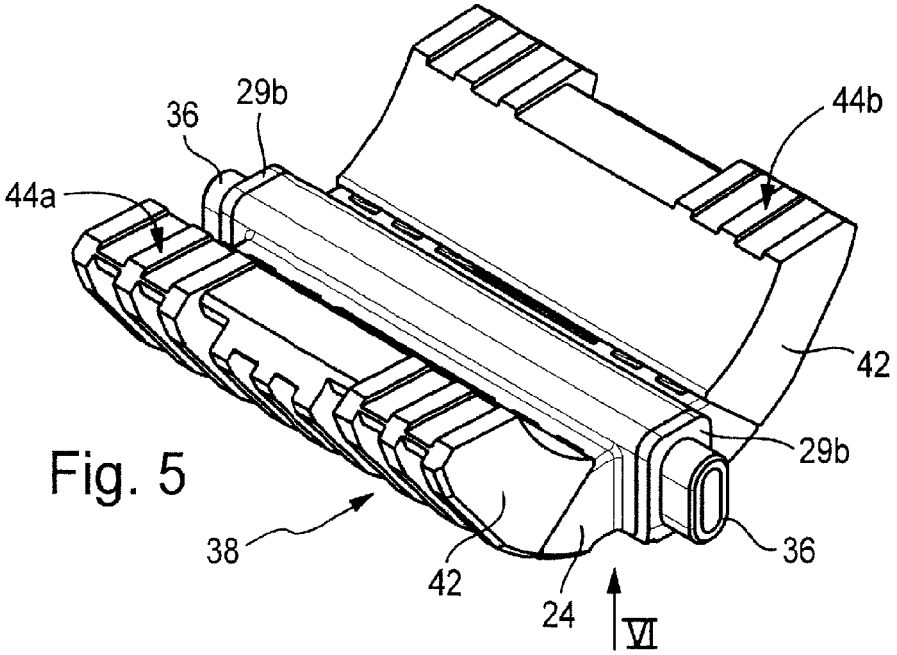
FIG. 5 the space divider and stop unit of FIG. 4 in a perspective view
Figure 6:
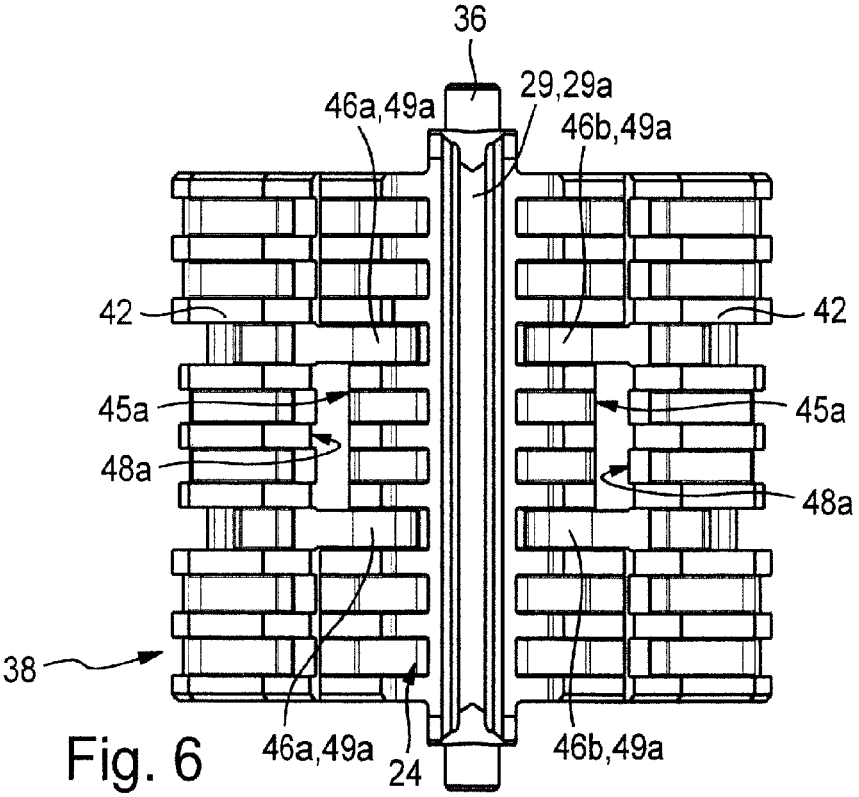
FIG. 6 the space divider and stop unit shown in FIGS. 4 and 5 in a rear view looking in the direction of arrow VI of FIGS. 4 and 5

If the space divider and stop unit 38 contains only two stop elements 42, each fitted to one of the two assembly interfaces 45*a*, 45*b*, then the second end faces 47*b* of the two stop elements 42 facing away from the space divider element 24 function as the two stop faces 44*a*, 44*b* for the vane section 23. This is illustrated in FIGS. 2 to 4. The second mounting interfaces 48*b* formed on the second end faces 47*b* of the stop elements 42 are in this connection without function.

Varying from the embodiment it would also be possible to fit a stop element 42 to only one of the two assembly interfaces 45*a* or 45*b*. In this case the end face of the space divider element 24 on the side 30 not equipped with a stop element 42 and facing in the main circumferential direction 34 would act as one of the stop faces 44*a*, as illustrated in FIG. 4 by the reference number "44*a*" being placed in brackets.

It is even possible to operate the rotary drive device 1 entirely without stop elements 42 fitted, in which case the two stop faces 44*a*, 44*b* are formed by the end faces, oriented opposite one another, on the two sides 30 of the space divider element 24. In this case the space divider and stop unit 38 consists only of the space divider element 24.

The equipping of each stop element 42 with a first mounting interface 48*a* and a second mounting interface 48*b* complementary to the former creates the advantageous possibility of combining several stop elements 42 to form a stop element chain which adjoins one of the two assembly interfaces 45*a*, 45*b*. For this purpose, only the stop elements 42 to be linked together are brought into engagement with the first and second mounting interfaces 48*a*, 48*b*, complementary to one another, with the assigned snap-in connection means 49*a*, 49*b* ensuring the stability of the connection. The number of stop elements 42 to be linked in a chain may in principle be as desired.

Figure 7:
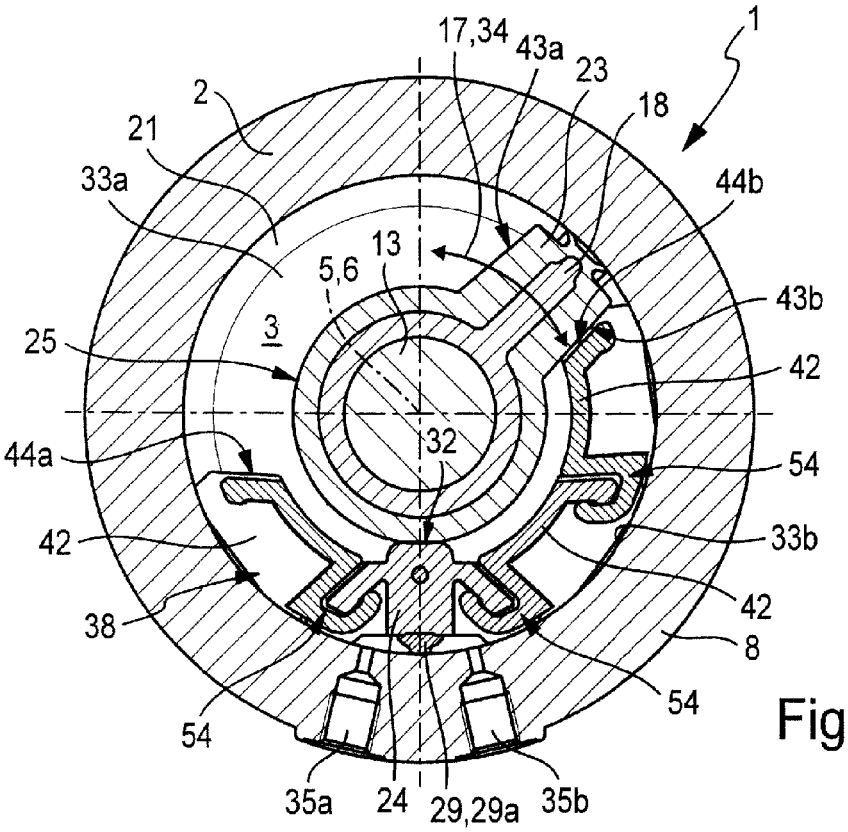
FIG. 7 the rotary drive device in a sectional view corresponding to FIG. 2, in which the space divider and stop unit is equipped with a further stop element to form a stop element chain FIG. 8 a detail view of the space divider and stop unit provided in the embodiment of FIG. 7
Figure 8:
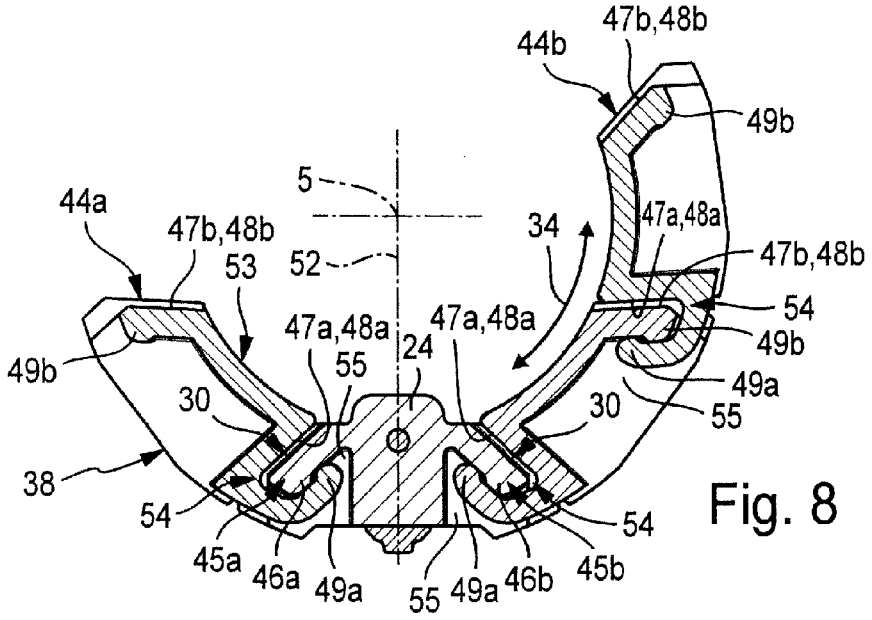
Figure 9:
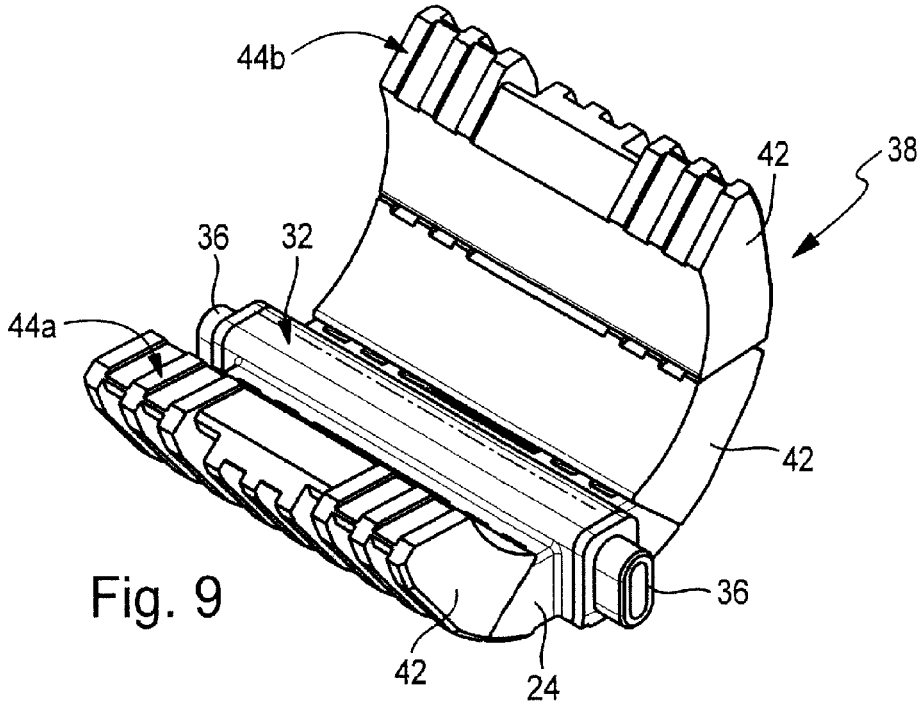
FIG. 9 the space divider and stop unit of FIGS. 7 and 8 in a perspective view FIG. 10 the rotary drive device in a sectional view corresponding to FIG. 2, in which the space divider and stop unit is equipped with an even greater number of stop elements, so that a stop element chain comprising in each case two stop element lies either side of the space divider element FIG. 11 the rotary drive device of FIG. 10 in a perspective view with housing partly removed and comparable to the view in FIG. 3
Figure 10:
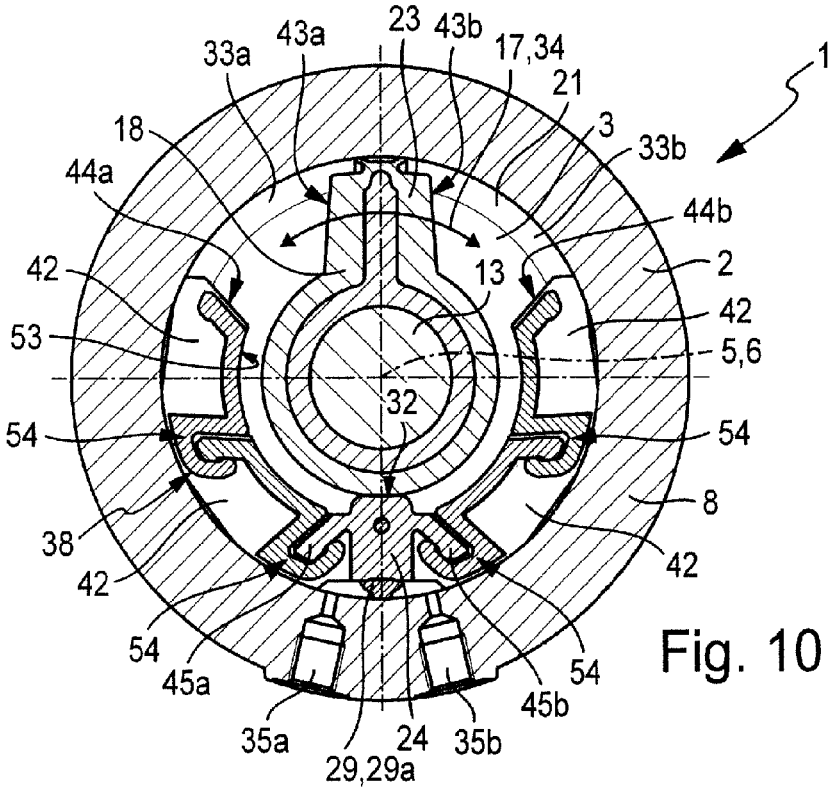
Figure 11:
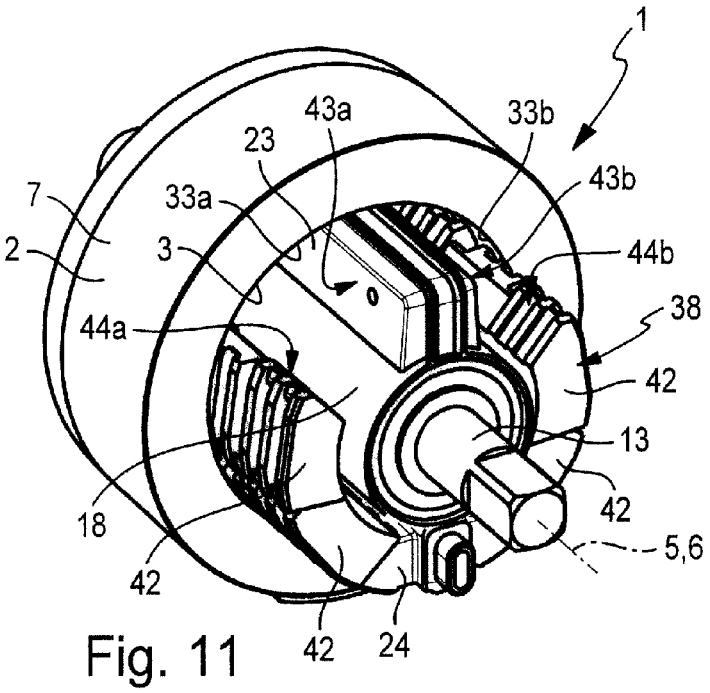
Figure 12:
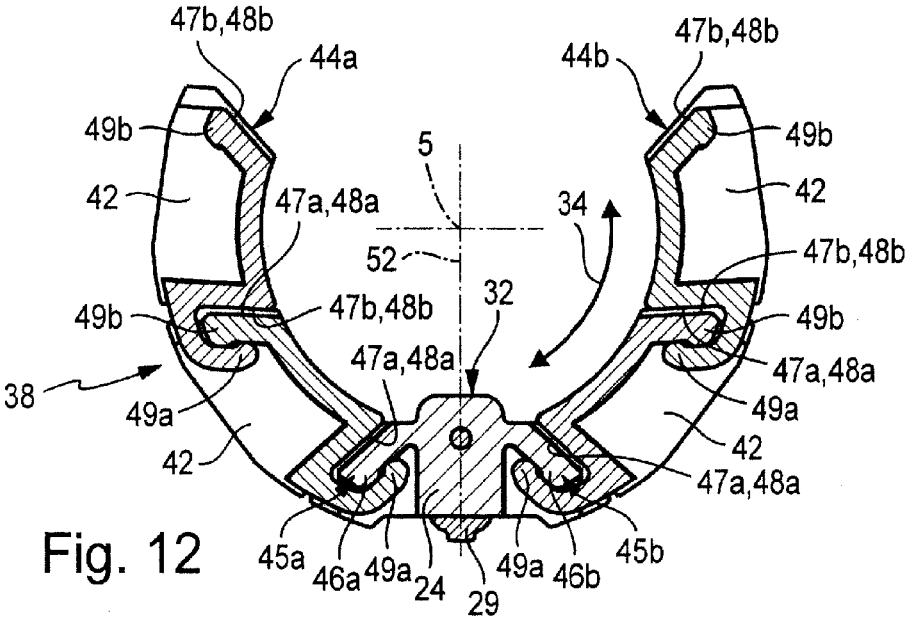
FIG. 12 a detail view of the version of a space divider and stop unit used in the rotary drive device according to FIGS. 10 and 11
Figure 13:
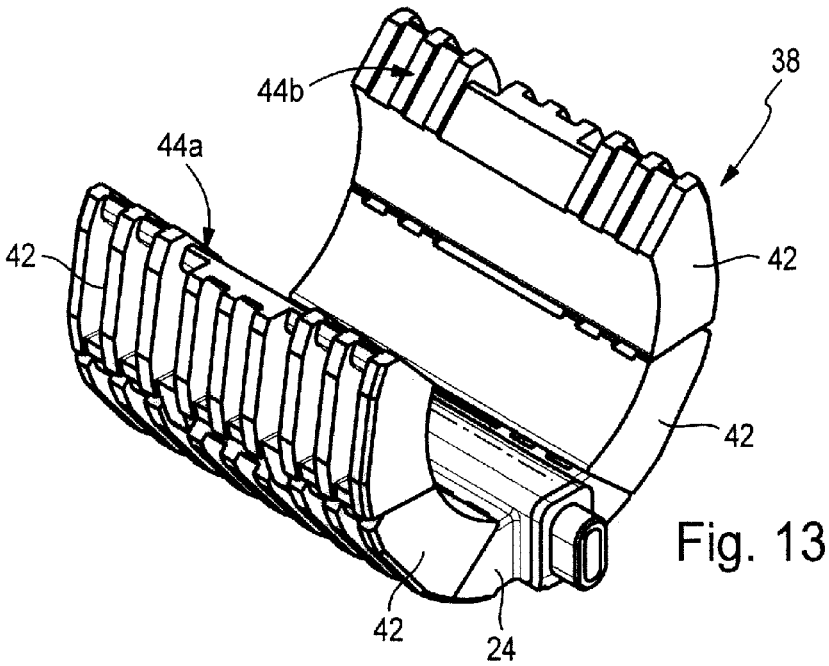
FIG. 13 the space divider and stop unit of FIG. 12 in a perspective view FIG. 14 a detail view of the space divider and stop unit illustrating the assembly process for the purpose of adding two further stop elements FIG. 15 the space divider and stop unit illustrated in FIGS. 4 to 6 in a perspective detail view before assembly of its components FIG. 16 the arrangement of FIG. 15 in a rear view looking in the direction of arrow XVI of FIG. 15
Figure 14:
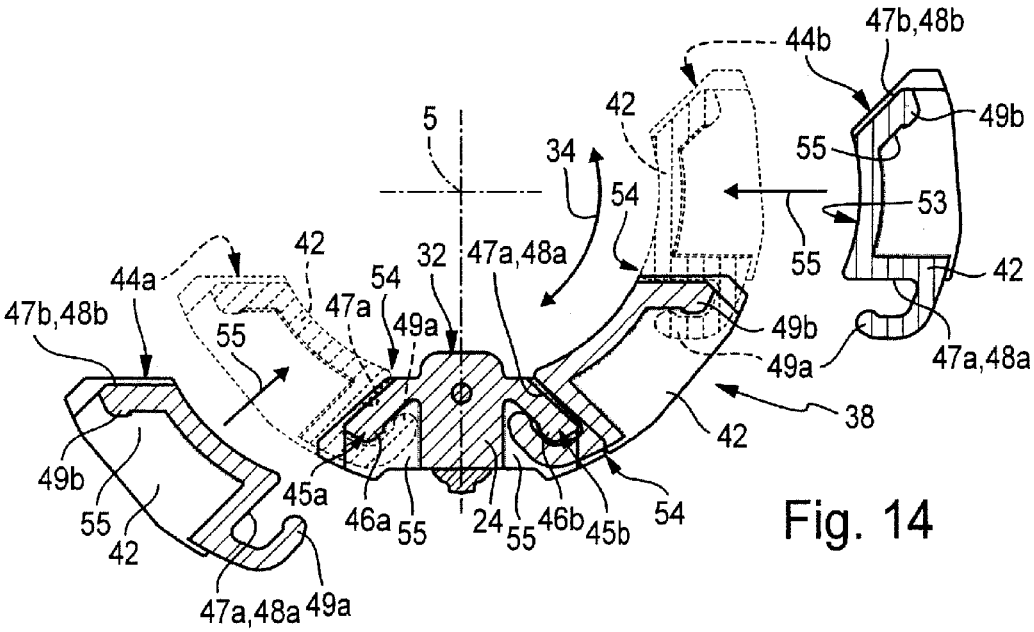
Figure 15:
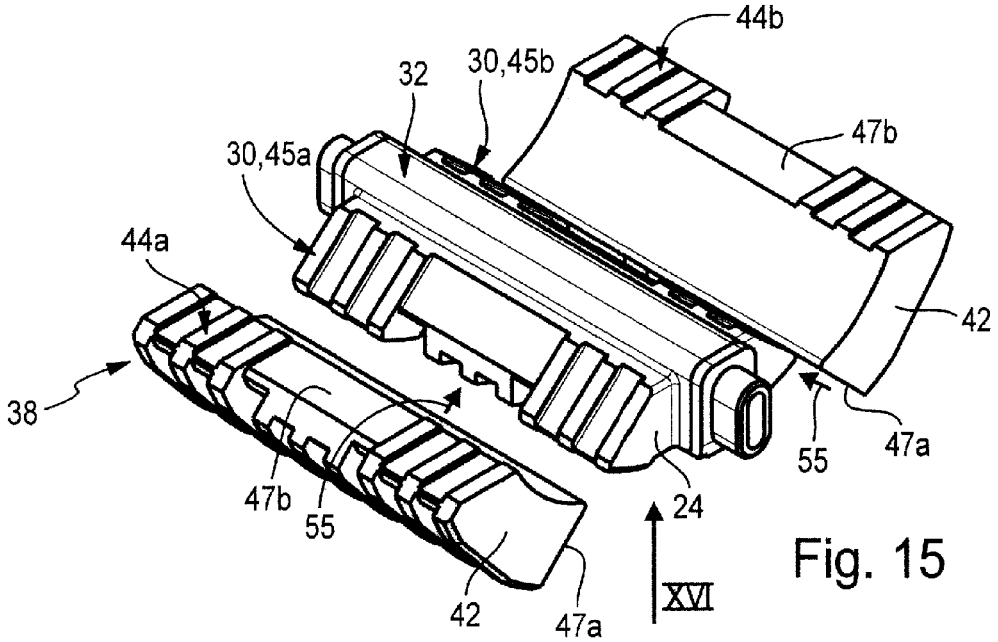
Figure 16:
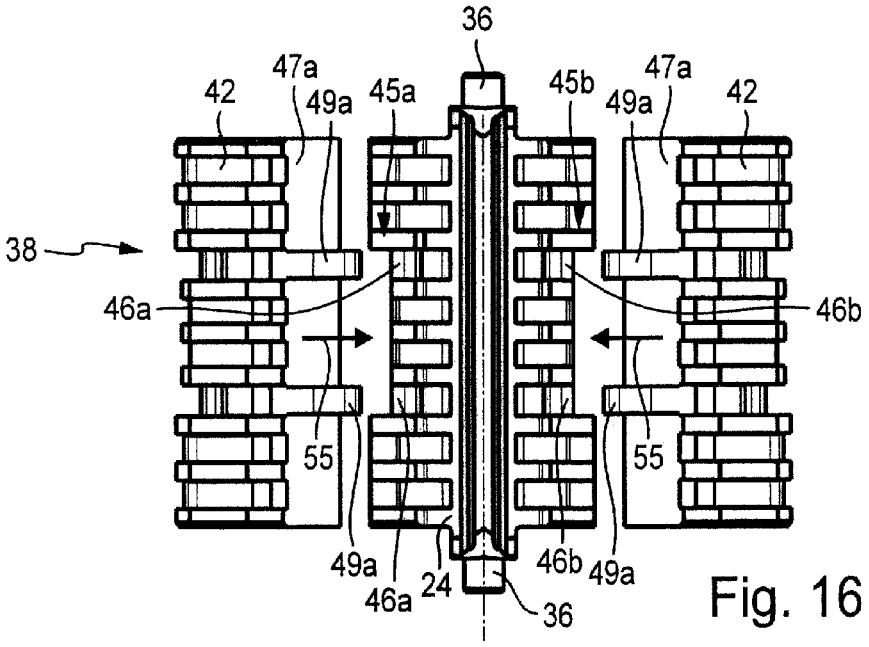
Figure 17:
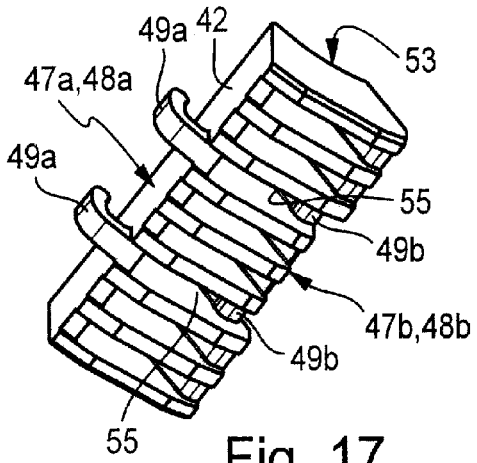
FIG. 17 a perspective detail view of one of the stop elements used in the rotary drive device FIG. 18 the stop element of FIG. 17 from a different angle of view FIG. 19 a perspective detail view of the space divider element used in the rotary drive device of the other Figures FIG. 20 the space divider element of FIG. 19 from a different angle of view
Figure 18:
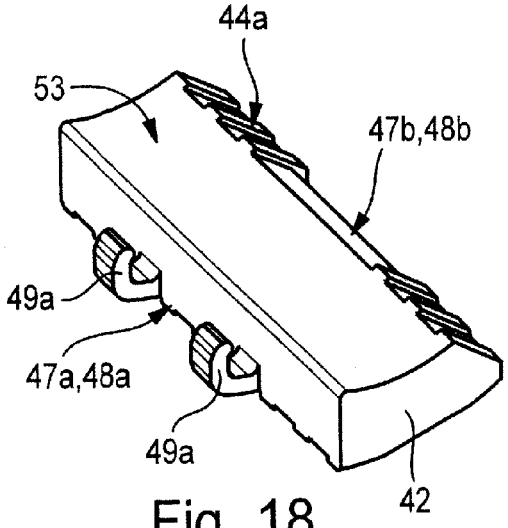
Figure 19:
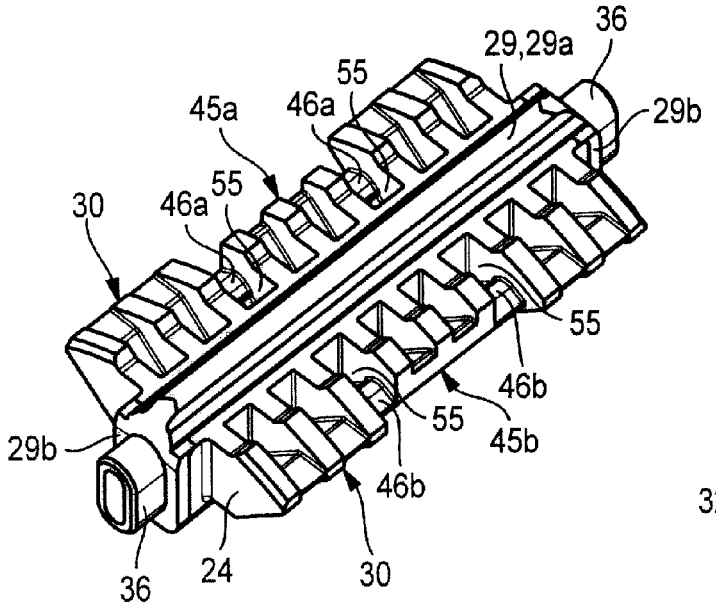
Figure 20:
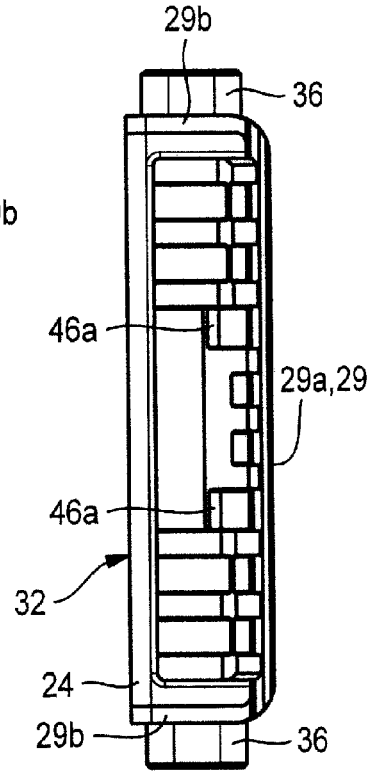

Shown in FIGS. 7 to 9 is a version of the space divider and stop unit 38 in which only a single stop element 42 is fixed to the one assembly interface 45*a*, while a stop element chain of two stop elements 42 lined up side by side is attached to the other assembly interface 45*b*. Here the single stop element 42 fitted on the one side of the space divider element 24 forms the one stop face 44*a*, while the other stop face 44*b* is defined by the last stop element 42*b* of the stop element chain, opposite the space divider element 24.

In FIGS. 10 to 13 the space divider and stop unit 38 is equipped at both assembly interfaces 45*a*, 45*b* with in each case one stop element chain comprised of two stop elements 42 lined up side by side and positively engaging with one another. Here each stop element chain forms with its outer stop element 42 one of the two stop faces 44*a*, 44*b*.

In all cases, the elements 24, 42 attached to one another are engaged together by the snap-in connection means 46*a*, 46*b*, 49*a*, 49*b*, so that a stable, inherently cohesive assembly is formed, which may be inserted into the working chamber 3 as an easily handled assembly module during assembly of the rotary drive device 1.

It is especially advantageous when the complementary snap-in connection means 46*a*, 46*b*, 49*a*, 49*b* are so designed that the snap-in connections which can be created with their aid are releasable. By this means the rotary drive device 1, in respect of the design of the space divider and stop unit 38, may be modified at any time to meet a changed application requirement.

The rotary drive device 1 is especially cost-effective if all stop elements 42 are designed to be identical to one another. This is the case in the embodiment. All stop elements 42 may therefore be produced using one and the same production tool. Moreover, stockholding is reduced to a minimum, since only a single type of stop element 42 must be provided.

If the rotary drive device 1 is equipped with a space divider and stop unit 38 which contains no stop elements 42 and consists only of the space divider element 24, then the maximum swivel angle of the swivel piston 18 is preset by the stop faces (44*a*) formed on this space divider element 24. In the embodiment this measure gives a maximum swivel angle of 270°.

Each stop element 42 is expediently so designed that, after its integration into the space divider and stop unit 38, a reduction of the preset swivel angle by an angular range of 45° occurs. Accordingly, in the embodiment of FIGS. 1 to 6, which is equipped with two stop elements 42, there is still a maximum swivel angle of 180°. In the embodiment of FIGS. 7 to 9, the maximum possible swivel angle is 135° and in the embodiment of FIGS. 10 to 13 it is 90°.

Each stop element 42 expediently has a curved circular arc shape such that the centre of curvature, viewed in the operating position, lies on the same side as the central axis 5, and in particular lies directly on this central axis 5. It is also of advantage if each stop element 42 has at least substantially a contour corresponding to a circumferential section of a hollow cylinder extending a short distance around the longitudinal axis.

Preferably the whole space divider and stop unit 38, irrespective of the number of stop elements 42 with which it is equipped, has a shape corresponding to a circumferential section of a hollow cylinder.

Due to the aforementioned design features it is possible to accommodate the space divider and stop unit 38 in a working chamber 3 of very small diameter, which facilitates the realisation of compact rotary drive devices 1.

In the operating position of the space divider and stop unit 38, each stop element 42 preferably has an inner surface 53 facing the swivel piston which is concave and has a circular-arc-shaped contour, with its centre lying on the central axis 5.

The snap-in connection means 46*a*, 49*a*; 46*b*, 49*a*; 49*a*, 49*b*, complementary to one another, are expediently in each case part of a separate plug connection device 54. By this means the various elements 24, 42 of the space divider and stop unit 38 may be easily plugged together for mutual fixing, while the snap-in connection is a result of this plugging-in process. The direction of plugging-in 55 shown by arrows in the drawing runs, viewed in the operating position of the space divider and stop unit 38, in particular in a plane at right-angles to the central axis 5 and preferably radially relative to the central axis 5. Otherwise expressed, the elements 24, 42 may be preferably plugged together in a direction transverse to and in particular at right-angles to the main circumferential direction 34, and may as required also be released from one another.

By way of example, the first assembly interface 45*a* formed on the space divider element 24 may form, together with a first mounting interface 48*a* of any desired stop element 42, a plug connection device 54. Similarly, the second assembly interface 45*b* provided on the space divider element 24 may also, together with the first mounting interface 48*a* of each stop element 42, form a plug connection device 54. And finally, the first mounting interface 48*a* of any desired stop element 42 may, together with the second mounting interface 48*b* of any desired further stop element 42, likewise form a plug connection device 54.

The snap-in connection means 46*a*, 46*b*, 49*a*, 49*b*, complementary to one another, are expediently hook-shaped, as may be seen especially clearly in FIGS. 4, 8, 12 and 14.

By way of example, the hook-shaped snap-in connection means 46*a*, 46*b* of the two assembly interfaces 45*a*, 45*b* bound a plug-in socket 55. The same applies to the snap-in connection means 49*b* of the second mounting interface 48*b* formed on the stop elements 42. The plug-in sockets 55 are in particular open towards the radial outside of the space divider element 24 and the stop elements 42 opposite the central axis 5.

The hook-shaped snap-in connection means 49*a* of the first mounting interface 48*a* formed on each stop element 42 have preferably the shape of substantially L-shaped arms extending to the side, with a width so matched to the width of the plug-in sockets 55 that they may be plugged into these plug-in sockets 55.

In the course of plug connection for the purpose of assembling the space divider and stop unit 38, the arm-like snap-in connection means 49*a* of the first mounting interface 48*a* are inserted or pushed into a plug-in socket 55 of the space divider element 24 or stop element 42 to be connected until the snap-in connection means 49*a* engage or snap into the other snap-in connection means 46*a*, 46*b*, 49*b* and thereby an element linkage, preferably easily releasable, is created.

Due to the fact that the elements 24, 42, in each case immediately consecutive in the main circumferential direction 34, are in the connected state in contact with one another by their facing end faces, a flexurally rigid plug connection is created, so that the space divider and stop unit 38 forms a self-supporting, inherently rigid structure which may be inserted easily into the working chamber 3, even using mechanical handling equipment.

The snap-in connections involved in assembly of the space divider and stop unit 38 may also be described as snap connections. One can also speak of the diverse elements 24, 42 being clipped together during assembly.

The stop elements 42 are preferably single-piece parts made of plastic material. The same plastic material is used preferably in production of the base body 28 of the space divider element 24.

In particular compressed air is used as driving fluid for the fluid-actuated rotary drive device 1, although any other gaseous medium or even fluidic medium may be used for this purpose.

The invention claimed is:

1. A fluid-actuated rotary drive device, with a housing in which is formed a working chamber, which has at least partially a circular external contour extending concentrically in a main circumferential direction around a central axis, wherein there is mounted in the working chamber a swivel piston connected in a non-rotatable manner to an output member accessible from outside the housing and able to execute a swiveling movement around the central axis, and with a space divider and stop unit which, in adopting an operating position, is or may be inserted in the working chamber so as to be immovable in such a way that it divides the working chamber, together with the swivel piston, into two drive chambers, which may be pressurized in a controlled manner by a driving fluid to generate the swivelling movement of the swivel piston, and at the same time presets the maximum possible swivel angle of the swivel piston, wherein the space divider and stop unit has a space divider element fixed immovably to the housing with sealing in the operating position and at least one stop element separate from the space divider element and while adopting a stop position being fitted or able to be fitted to the space divider element on at least one of the two sides thereof oriented in the main circumferential direction at an assembly interface, and wherein each stop element is fixed in its stop position by sole interaction with the space divider element by means of a snap-in connection on the space divider element, with snap-in connection means formed on the stop element making positive snap-in engagement with complementary snap-in connection means formed on the space divider element, and wherein the snap-in connection means of the space divider element comprises a hook-shaped arm forming a plug-in socket having an opening facing towards the radial outside of the space divider element opposite the central axis, and wherein the snap-in connection means on the stop element comprises a hook-shaped arm forming a plug-in socket having an opening facing towards the central axis, and wherein the hook-shaped arm of the space divider element is received within the plug-in socket of the stop element and the hook-shaped arm of the stop element is received within the plug-in socket of the space divider via a movement of the stop element with respect to the space divider in a plug-in direction radially toward the central axis.

2. A rotary drive device according to claim 1, wherein the space divider element has on both its opposite sides oriented in the main circumferential direction an assembly interface with snap-in connection means, such that it is or may be equipped as desired on one or both sides with at least one stop element to form a snap-in connection.

3. A rotary drive device according to claim 1, further comprising several stop elements, which may be or are fitted to at least one side of the space divider element oriented in the main circumferential direction to form a stop element chain, wherein in the main circumferential direction in each case adjacent stop elements of the stop element chain are fixed to one another by snap-in connection means, and wherein the outer stop element terminating the stop element chain on the side opposite the space divider element has a stop face for the swivel piston.

4. A rotary drive device according to claim 3, wherein, on both sides of the space divider element opposite one another and each oriented in the main circumferential direction, a stop element chain of several stop elements linked together by snap-in connection means is or may be fitted.

5. A rotary drive device according to claim 1, wherein each stop element has two first and second end faces opposite one another and oriented in the main circumferential direction, wherein there is formed in the area of the first end face a first mounting interface with snap-in connection means for snap-in connection with an assembly interface of the space divider element.

6. A rotary drive device according to claim 5, wherein there is formed in the area of the second end face of each stop element a second mounting interface complementary to the first mounting interface and with snap-in connection means, such that at least two stop elements may be or are fixed together with their first and second mounting interfaces engaging to form a stop element chain.

7. A rotary drive device according to claim 5, wherein, in the area of the second end face of each stop element, a stop face for the swivel piston is formed.

8. A rotary drive device according to claim 1, wherein all stop elements are designed to be identical to one another.

9. A rotary drive device according to claim 1, wherein the complementary snap-in connection means are designed to create a releasable snap-in connection.

10. A rotary drive device according to claim 1, wherein each fitted stop element is so designed that, in the operating position of the space divider and stop unit, it reduces the maximum possible swivel angle of the swivel piston by 45° compared with the state in which the stop element is unfitted.

11. A rotary drive device according to claim 1, wherein each stop element has a curved circular-arc shape following the main circumferential direction in the operating position of the space divider and stop unit.

12. A rotary drive device according to claim 1, wherein each stop element has substantially a shape corresponding to a circumferential section of a hollow cylinder.

13. A rotary drive device according to claim 1, wherein the space divider and stop unit has substantially a shape corresponding to a circumferential section of a hollow cylinder.

14. A rotary drive device according to claim 1, wherein each stop element has an inner surface, facing the swivel piston in the operating position of the space divider and stop unit, with a convex shape.

15. A rotary drive device according to claim 1, wherein each of the complementary snap-in connection means is hook-shaped.

16. A rotary drive device according to claim 1, wherein elements of the space divider and stop unit fixed together by snap-in connection means are supported by end faces abutting one another and oriented in the main circumferential direction so as to be immovable relative to one another.

17. A rotary drive device according to claim 1, wherein the space divider element has a base body and a seal, material-bonded to the former and in sealing contact with the wall of the housing bordering the working chamber in the operating position of the space divider and stop unit.

18. A rotary drive device according to claim 1, wherein the hook-shaped arm of the space divider element comprises a projection projecting into the plug-in socket of the space divider element, and wherein the hook-shaped arm of the stop element comprises a projection projecting into the plug-in socket of the stop element, the projection of the hook-shaped arm of the space divider element engaging the projection of the hook-shaped arm of the stop element to prevent movement of the stop element with respect to the space divider in a reverse direction away from the central axis opposite the plug-in direction.

* * * * *